United States Patent [19]

Nagai et al.

[11] Patent Number: 4,744,339

[45] Date of Patent: May 17, 1988

[54] CENTRIFUGAL SPARK-ADVANCE CONTROL DEVICE

[75] Inventors: Shigeru Nagai; Yasuhide Sakamoto; Hiromitsu Sato; Hideji Ohura; Masashi Kawamata; Masayuki Kumada, all of Wako, Japan

[73] Assignee: Honda Giken Kogyo Kabushiki Kaisha, Tokyo, Japan

[21] Appl. No.: 58,764

[22] Filed: Jun. 5, 1987

[30] Foreign Application Priority Data

Jun. 6, 1986 [JP] Japan ..... 61-130244
Nov. 28, 1986 [JP] Japan ..... 61-281991

[51] Int. Cl.[4] ..... F02P 5/04
[52] U.S. Cl. ..... 123/146 S A; 123/420
[58] Field of Search ..... 123/420, 146.5 A

[56] References Cited

U.S. PATENT DOCUMENTS

| | | | |
|---|---|---|---|
| 2,717,286 | 9/1955 | Bales | 123/146.5 A |
| 2,821,185 | 1/1958 | McCarty | 123/146.5 A |
| 2,905,162 | 9/1959 | Johnson | 123/146.5 A |
| 3,923,028 | 12/1975 | Campbell | 123/146.5 A |
| 4,055,157 | 10/1977 | Gehring | 123/420 |
| 4,640,239 | 2/1987 | Green | 123/146.5 A |

FOREIGN PATENT DOCUMENTS

| | | | |
|---|---|---|---|
| 59-12870 | 3/1984 | Japan | 123/146.5 A |
| 59-128978 | 7/1984 | Japan | 123/146.5 A |

*Primary Examiner*—Ronald B. Cox
*Attorney, Agent, or Firm*—Stevens, Davis, Miller & Mosher

[57] ABSTRACT

Disclosed is a centrifugal spark-advance control device for an ignition system of an internal combustion engine, comprising: a base plate which rotates at a speed corresponding to the rotational speed of the engine; a timing plate which is rotatably supported on the base plate; a spring for biasing the timing plate in a certain direction; a centrifugal weight which is pivoted to the base plate at a point spaced from the center of gravity of the centrifugal weight and which is provided with a cam surface for rotatably driving the timing plate in an opposite direction against the biasing force of the spring by cooperating with a corresponding cam follower surface provided in the timing plate; a spark generating device coupled to the timing plate for generating ignition sparks in synchronism with the rotational angle of the timing plate; a mass member attached to the timing plate by way of an elastic member. Since the mass member is elastically supported by the timing plate, undesirable vibration of the timing plate is minimized by the action of a dynamic damper provided by the mass member and the accuracy in ignition timing is assured.

15 Claims, 5 Drawing Sheets

CENTRIFUGAL SPARK-ADVANCE CONTROL DEVICE

TECHNICAL FIELD

The present invention relates to a vacuum spark-advance control device for an ignition distributor of an internal combustion engine and in particular to a vacuum spark-advance control device which is free from torsional oscillation of a member which determines spark timing and can thereby achieve an accurate spark-advance control.

BACKGROUND OF THE INVENTION

FIG. 3 shows an essential part of a conventional centrifugal spark-advance control device for an ignition distributor which comprises a base plate a which is integrally connected to an input shaft which is not shown in the drawing, a pair of centrifugal weights b which are rotatably supported at their points offset from their gravitational centers by pivot pins c fixedly secured to the base plate a, a pulse generator drive shaft d which is rotatably supported on the free end of the input shaft in a coaxial manner, a timing plate e which has the shape of letter "Z" and is fixedly secured to the pulse generator drive shaft d, a pair of tension coil springs g, h which are engaged across pins j of the timing plate e and the pivot pins c of the centrifugal weights b and bias the timing plate e in the direction to delay the ignition timing. As the rotational speed of the input shaft and the whole assembly increases and the centrifugal weights b turn in clockwise direction about the pins c under the centrifugal force acting thereon, the cam surfaces provided in the centrifugal weights b drive the timing plate e in the direction to advance the ignition timing against the biasing force of the coil springs g, h. One of the coil springs h is engaged to the pin j of the timing plate e with a certain gap i therebetween and is adapted to be effective only when the rotational angle of the timing plate e has increased beyond a certain extent and the gap i is eliminated.

According to this conventional structure, if the rotational speed of the input shaft contains any ripple or oscillating fluctuations, the ripple is directly transmitted to the pulse generator and this could cause errors in ignition timing and impair the efficiency of the engine.

Normally, the input shaft of the distributor is connected to a cam shaft for actuating engine intake and exhaust valves by way of an Oldham coupling or the like, and the centrifugal spark-advance control device is interposed between the input shaft and the pulse generator drive shaft. Since the cam shaft receives a force opposing its rotation when each of the cams provided on the cam shaft opens an exhaust or intake valve of the engine against spring force of the valve spring and a force assisting the rotation thereof when the cam closes the valve under the spring force of the valve spring. Such fluctuations in the load acting upon the cam shaft may cause a ripple in the rotational speed of the cam shaft which in turn causes an error in the ignition timing by changing the contact state of the Oldham coupling.

To the end of eliminating this problem, it has been proposed in Japanese Patent Publication No. 59-128978 to provided a cam in the input shaft of an ignition distributor and a device serving as a load to this cam such as a fuel pump is provided in the housing of the ignition distributor in such a manner that generation of vibrations due to the existence of gaps in the Oldham coupling can be prevented by applying a biasing force to the input shaft and closing the gaps at all times.

However, according to this proposal, the addition of a cam and a device serving as a load to the ignition distributor necessitates the increase in the external diameter of the ignition distributor and the length of the input shaft and this is highly disadvantageous in modern automotive engines which are required to be highly compact.

Japanese Patent Publication No. 59-12870 proposes the use of a pair of certain stoppers which are intended to stabilize the angular positions of centrifugal weights but these stoppers are not capable of reducing the vibration of the centrifugal weights or the timing plate.

In view of such problems of the prior art, a primary object of the present invention is to provide a centrifugal spark-advance control device for an internal combustion engine which is free from the fluctuation in the ignition timing due to the twisting oscillation or the ripple in the rotational speed of the input shaft to the ignition distributor.

A second object of the present invention is to provide a centrifugal spark-advance control device for an internal combustion engine which is free from the fluctuation in the ignition timing and is yet compact.

This and other objects of the present invention can be accomplished by providing a centrifugal spark-advance control device for an ignition system of an internal combustion engine, comprising: an input shaft which rotates at a speed corresponding to the rotational speed of the engine; a base plate fixedly attached to the input shaft; a timing member which is rotatably supported on the base plate; a biasing means for biasing the timing member in a certain direction; a centrifugal weight which is pivoted to the base plate at a point spaced from the center of gravity of the centrifugal weight and which is provided with a cam surface for rotatably driving the timing member in an opposite direction against the biasing force of the biasing means by cooperating with a corresponding cam follower surface provided in the timing member; a spark generating means coupled to the timing member for generating ignition sparks in synchronism with the rotational angle of the timing member; a mass member attached to the timing plate by way of an elastic member.

According to this structure, as the mass member serving as an anti-vibration mass which is supported by the elastic member vibrates at a certain phase relationship with respect to the timing plate, the twisting vibration of the timing plate is canceled by the inertia force of the anti-vibration mass and the fluctuations in the ignition timing can be eliminated.

According to a certain aspect of the present invention, the timing member comprising a timing plate which is adapted to rotate in a major plane thereof and the mass member comprises a mass plate which is attached to a major surface of the timing plate by way of an elastic member consisting of a layer of elastomer material. Preferably, the timing plate has a pair of arms extending radially on either side of the rotational center thereof and each carrying the mass plate thereon. These features are helpful for accomplishing a compactness in spark distributor design.

According to another aspect of the present invention, the free ends of the arms of the timing plate are each provided with an extension extending in circumferential direction and the mass plates are carried by these circumferential extensions. This feature enhances the action of the dynamic damper by increasing the moment of inertia of the mass plates.

According to yet another aspect of the present invention, the timing plate and the mass plate are provided with holes which are filled with part of the material of the elastomer layer. Additionally or alternatively, a pin which is integrally connected to the timing plate is passed through the mass plate defining a certain clearance therebetween and this clearance may be filled with the elastomer material in a similar manner. These features improve the durability and reliability of the bonding between the timing plate and the mass plates.

According to yet another aspect of the present invention, the centrifugal weight is provided with a cam follower pin while the timing plate is provided with a cam slot receiving the cam follower pin. Preferably, the mass plate covers a substantially whole major surface of the timing plate except for the cam slot. These features maximize the moment of inertia of the mass plate without impairing the economy of space.

BRIEF DESCRIPTION OF THE DRAWINGS

The present invention will now be shown and described in the following in terms of concrete embodiments thereof with reference to the appended drawings, in which.

DETAILED DESCRIPTION OF THE INVENTION

Figure 1:
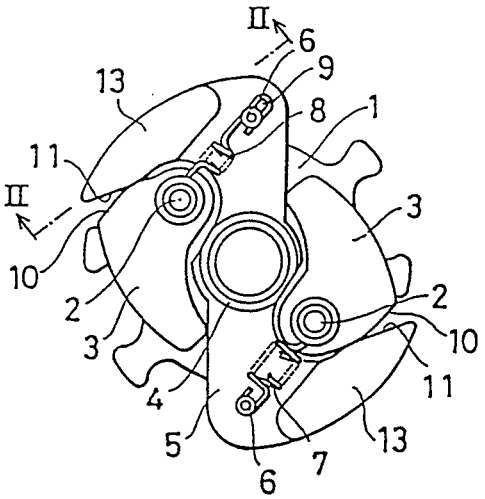
FIG. 1 is a plan view of a first embodiment of the centrifugal spark-advance control device of the present invention.
Figure 2:
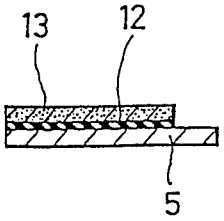
FIG. 2 is a sectional view taken along line II—II of FIG. 1.

FIGS. 1 and 2 show an embodiment of the centrifugal spark-advance control device of the present invention. A base plate 1 of this centrifugal spark-advance control device is adapted to be rotatively driven by an input shaft (which is not shown in the drawings which is in turn driven by a cam shaft of an engine (which is also not shown in the drawings but is coupled to the input shaft by way of an Oldham coupling). A pair of pins 2 project from the upper surface of the base plate 1 and pivotally support a pair of centrifugal weights 3 having centers of gravity offset from their pivot points. A pulse generator drive shaft 4 which consists of a hollow shaft integrally provided with a timing plate 5 having the shape of letter "Z" in plan view is rotatively supported by the input shaft. The timing plate 5 is also provided with a pair of pins 6 at its diagonal positions and a pair of tension coil springs 7 and 8 are engaged across the pins 2 and 6 of the base plate 1 and the timing plate 5, respectively. One of the coil springs 7 is simply engaged across the two corresponding pins 2 and 6, but the other coil spring 8 is engaged to the pin 6 with a certain gap 9 so that the latter spring 8 is not effective until the rotational speed of the input shaft has exceeded a certain certain value and the timing plate 5 has rotated in clockwise direction beyond a certain extent as described hereinafter.

As the rotational speed of the input shaft is increased, the centrifugal weights 3 are radially biased by the centrifugal force acting thereon and rotates in clockwise direction about the pins 2. As a result, cam surfaces 10 of the centrifugal weights 3 push corresponding cam follower surfaces 11 of the timing plate 5 and drives the timing plate 5 in clockwise direction against the biasing force of the tension coil springs 7 and 8.

According to the present present embodiment, an anti-vibration mass plate 13 is attached to each of the arms of the timing plate 5 by way of a rubber layer 12. These anti-vibration mass plates 13 supported by the rubber layers 12 serve as a dynamic damper.

Figure 3:
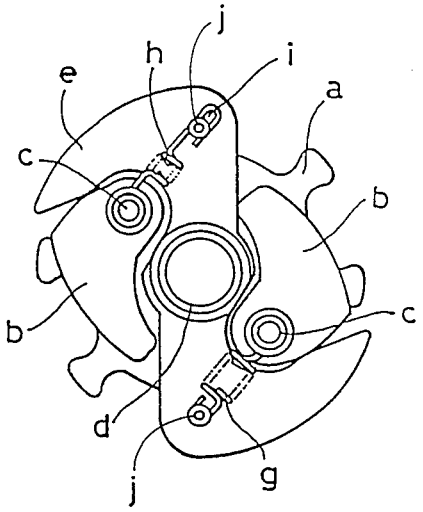
FIG. 3 is a plan view of a conventional centrifugal spark-advance control device.
Figure 5:
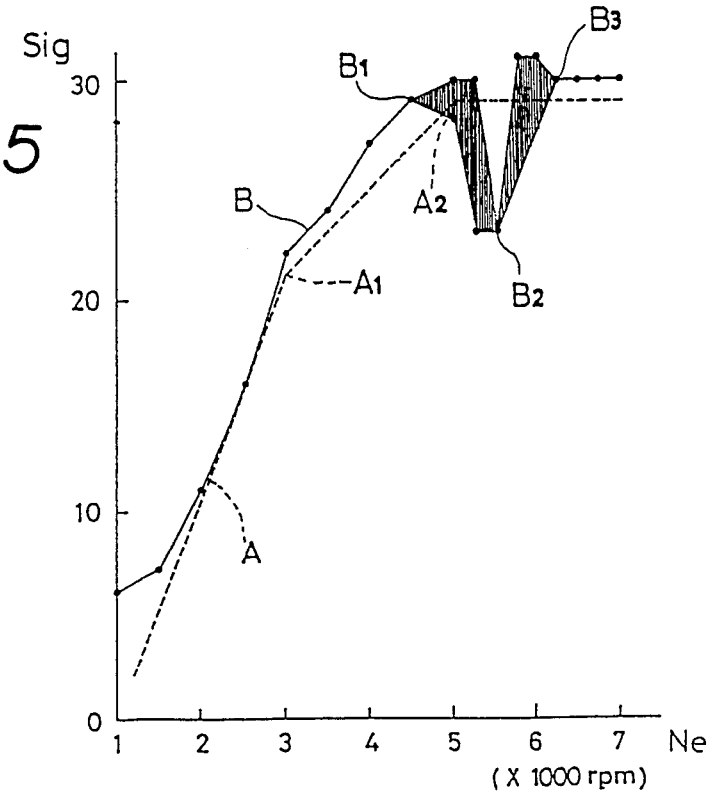
FIG. 5 is a graph showing the changes in the advance angle $S_{ig}$ of the ignition timing of the conventional centrifugal spark-advance control device as the rotational speed Ne of the input shaft is increased.
Figure 6:
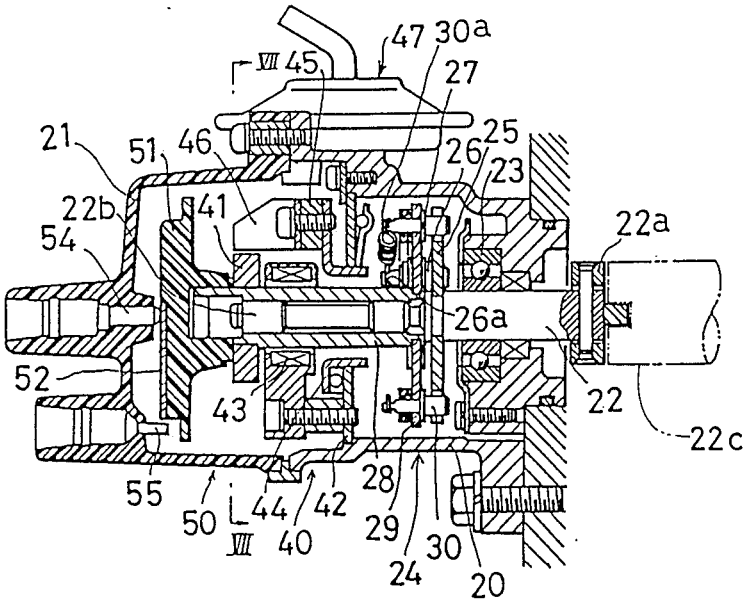
FIG. 6 is a sectional view of an ignition distributor to which a second embodiment of the present invention is applied.

The conventional centrifugal spark-advance control device shown FIG. 3 demonstrates the property given in the graph of FIG. 5. In this graph, the broken line A denotes an ideal property in which only one of the springs 7 is effective up to point A1 and both the coil springs 7 and 8 are effective from point A1 to point A2 at which the timing plate is prevented from any further displacement and the advancing of the spark timing is terminated. The actual advance ignition timing advance angle $S_{ig}$ of the conventional centrifugal spark-advance control device shown in FIG. 3 changed with the rotational speed Ne of the engine as shown by the solid line B in the graph of FIG. 5. In the interval between the point B1 corresponding to the engine speed Ne of 4,500 rpm and the point B2 corresponding to the engine speed Ne of 5,500 rpm, the spark advance angle fluctuated over a range of 7 degrees, and this fluctuation also occurred in the range between the point B2 and the point B3 corresponding to the engine speed Ne of 6,250 rpm.

Figure 4:
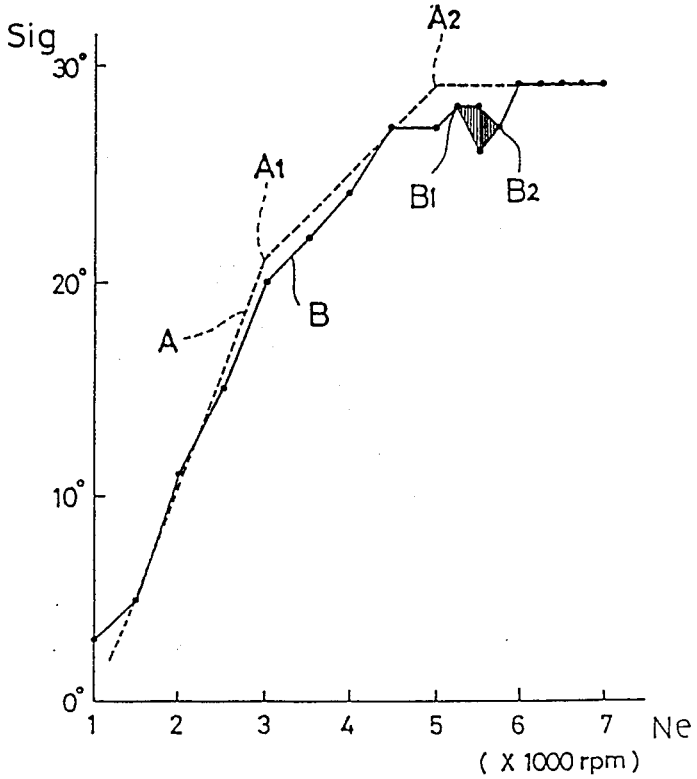
FIG. 4 is a graph showing the changes in the advance angle $S_{ig}$ of the ignition timing of the present invention as the rotational speed Ne of the input shaft is increased.

On the other hand, in the centrifugal spark-advance control device of the present invention, the spark advance angle fluctuated only in the interval between the point B1 corresponding to the engine speed Ne of 5,250 rpm and the point B2 corresponding to the engine speed Ne of 5,750 rpm as shown by the solid line B in the graph of FIG. 4, but the range of fluctuations was no more than two degrees.

Now another embodiment of the present invention is described in the following with reference to FIGS. 6 to 10.

Numerals 20 and 21 denote a casing and a cap of an ignition distributor. The casing 20 supports an input shaft 22 by way of a ball bearing 23 in a freely rotatable manner. The centrifugal spark-advance control device 24 which is incorporated in this spark distributor comprises a base plate 25 which is fixedly secured to the input shaft 22, a pair of pins 26 which project from the base plate 25 and a pair of centrifugal weights 27 which are supported by the pivot pins 26, respectively, in a freely rotatable manner. The free ends of the pins 26 are each provided with an annular groove 26*a* for engaging one ends of tension coil springs 38 and 39 which are described hereinafter.

The base end of the input shaft 22 is connected to a cam shaft 22*c* by way of an Oldham coupling 22*a* while the free end 22*b* of this input shaft 22 supports a hollow drive shaft 28 for a pulse generator. The base end of the drive shaft 28 is integrally provided with a timing plate 29 having the shape of letter "Z". A pair of pins 30 project from diagonal positions of the timing plate 29 and the free end of each of the pins 30 is provided with an annular groove 30*a* for engaging the other end of the corresponding tension coil spring 38 or 39.

Figure 10:
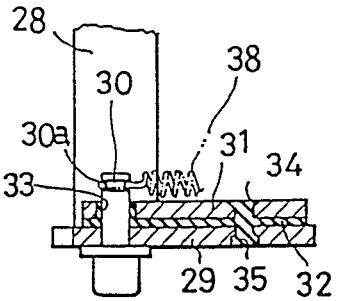
FIG. 10 is a sectional view taken along line X—X of FIG. 9.

As best shown in FIG. 10, an anti-vibration mass plate 31 is attached to each of the two arms of the timing plate 29 by way of a rubber layer 32. The anti-vibration mass plate 31 is provided with a straight through hole 33 and a countersunk through hole 34. The pin 30 is passed through the through hole 33 defining a large clearance therebetween. A stepped through hole 35 (which may also be a countersunk hole) similar to the countersunk through hole 34 of the anti-vibration mass plate 31 is provided in the timing plate 29 in alignment with the countersunk through hole 34. The clearance between the pin 30 and the through hole 33 and the interior of the mutually aligned through holes 34 and 35 are filled with rubber material which is formed at the same time as the rubber layer 32.

Thus, the anti-vibration mass plate 31 can oscillate along its major surface and perpendicularly thereto with respect to the timing plate 29 by being elastically supported by the rubber layer 32 and functions as a dynamic damper in the same manner as in the previous embodiment. Additionally, since the pin 30 is received in the through hole 33 of the anti-vibration mass plate 31, even when the rubber layer 32 has deteriorated over time and has partly peeled off, the anti-vibration mass plate 24 will continue to be held in place by the pin 30 which is received in the through hole 33 of the anti-vibration mass plate 24 and the possible unbalance in the rotating parts can be minimized.

The rubber material fills the countersunk through hole 34 and the stepped hole 35 and the clearance between the pin 30 and the through hole 33 in this embodiment, but if the bonding capability of the rubber layer 32 is sufficient, the rubber material filling these holes can be omitted. The clearance between the pin 30 and the through hole 33 obviously must be of a sufficient size to permit the required oscillating motion of the anti-vibration mass plate 31 relative to the timing plate 29.

In the same manner as the previous embodiment, the centrifugal weights 27 are each provided with a cam surface 36 which cooperates with a cam follower surface 37 provided in the corresponding part of the timing plate 29, and a pair of coil springs 38 and 39 are engaged across the pivot pins 26 of the centrifugal weights 31 and the pins 30 provided in the timing plate 29. These coil springs 38 and 39 bias the cam surfaces 36 and the cam follower surfaces 37 toward each other whereby the timing plate 29 is advanced in angle in clockwise direction according to the rotational motion of the centrifugal weights 27 about their pivot pins 26 and the anti-vibration mass plate 31 is prevented from coming off from the pins 31 in case the anti-vibration mass plate 31 has peeled off from the timing plate 29 due to loss of the bonding capability of the rubber layer 32. It is also possible to prevent the anti-vibration mass plate 31 from coming off from the timing plate 29 by fitting clips or washers onto the pins 30 as required.

Figure 7:
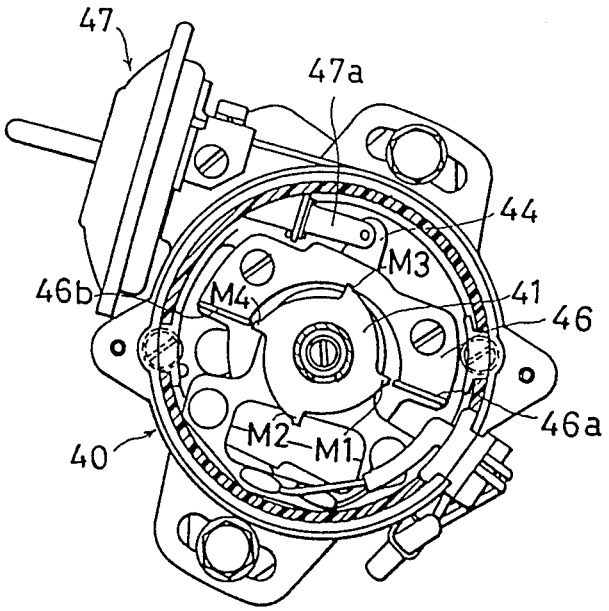
FIG. 7 is a sectional view taken along line VII—VII of FIG. 6.
Figure 8:
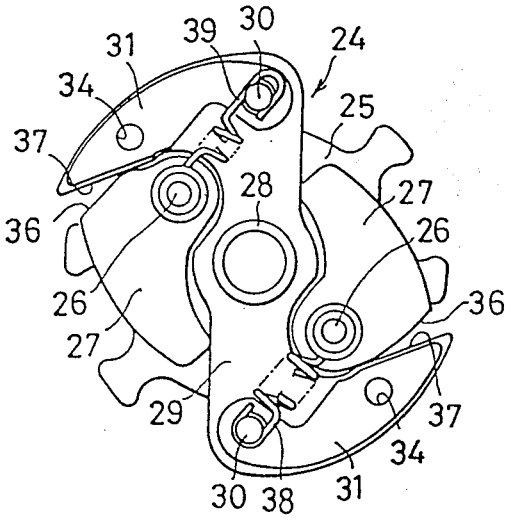
FIG. 8 is a plan view of the centrifugal spark-advance control device of the ignition distributor of FIG. 6.
Figure 9:
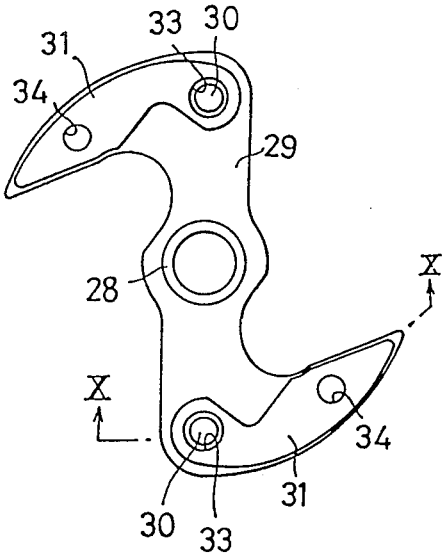
FIG. 9 is a plan view of the timing plate.

The pulse generator 40 is of a per se known type which comprises a variable reluctance member 41, an ignition timing detection coil 43 which is fixedly secured to a fixed base 42, a permanent magnet 45 which is fixedly attached to a moveable base 44, a stator core 46 and a vacuum spark-advance control device 47 which is coupled to the moveable base 44 by way of a push rod 47*a* as best shown in FIG. 7.

As shown in FIG. 7, the variable reluctance member 41 is provided with four magnetic poles H1 to H4 corresponding to the cylinders of the engine and induces an electromotive force in the ignition timing detection coil 43 when the magnetic poles H1 and H4 or H2 and H3 have aligned with the two magnetic poles 46*a* and 46*b* of the stator core 46 which is fixedly attached to the moveable base 44. The rotational angle of the moveable base 44 is controlled by the push rod 47*a* of the vacuum spark-advance control device 47 which is connected to the moveable base 44.

The distributor unit 50 comprises a rotor 51 which is fixedly secured to the hollow drive shaft 28, a brush 52 provided in the free end surface of the rotor 51, a central electrode 54 provided in the distributor cap 21 and secondary electrodes 56 of the same number as the number of the cylinders of the engine surrounding the central electrode 54, and electric ignition current is directed to either one of the secondary electrodes 56 when it has squarely opposed the brush 52 as the rotor 51 rotates.

Figure 11:
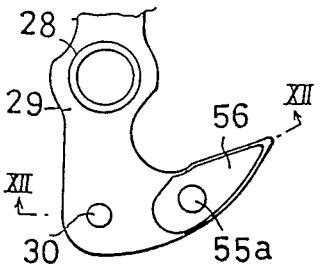
FIG. 11 is a sectional view of a part of a third embodiment of the present invention.
Figure 12:
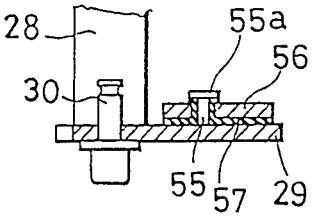
FIG. 12 is a sectional view taken along line XII—XII of FIG. 11.

In the embodiment illustrated in FIGS. 11 and 12, a pin 55 which is separate from the pin 30 for engaging one end of the coil spring 38 is used for assuring the connection of the anti-vibration mass plate 56 to the timing plate 29 by way of the rubber layer 57, and the pin 55 is fixedly secured to the timing plate 29 with projection welding while its head 55*a* is crimped over the anti-vibration mass plate 56.

FIGS. 13 to 17 show yet another embodiment of the present invention in which the main concept of the present invention is applied to an ignition distributor of a different type.

Figure 13:
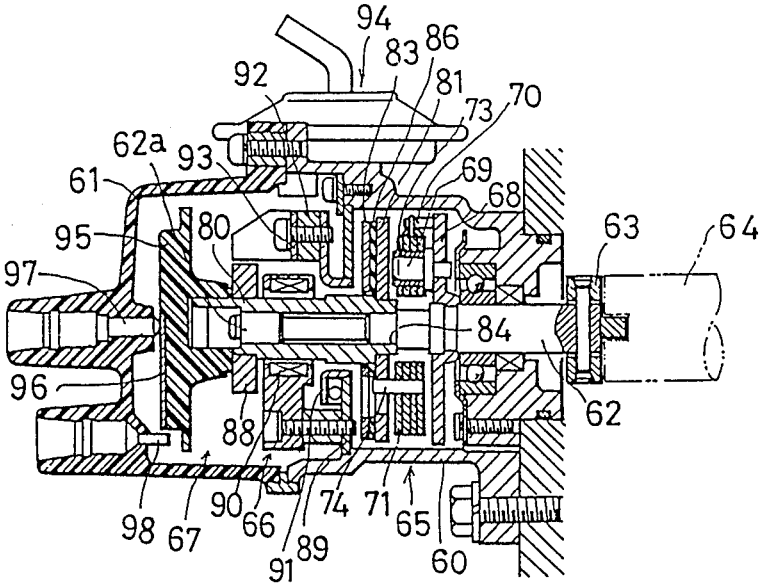
FIG. 13 is a sectional view of an ignition distributor to which a fourth embodiment of the present invention is applied.

FIG. 13 is a sectional view of the spark distributor which comprises a casing 60, a cap 61 fitted thereon and an input shaft 62 rotatably supported in the casing 60. The base end of the input shaft 62 is connected to a cam shaft 64 by way of an Oldham coupling 63 while the free end of the input shaft 62 is provided with a centrifugal spark-advance control device 65, a pulse generator 66 and a distributor unit 67.

Figure 14:
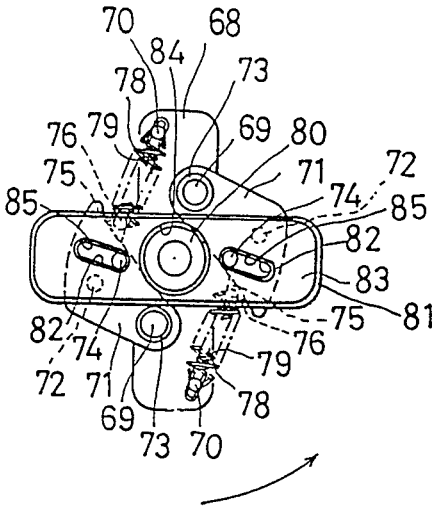
FIG. 14 is a plan view of the embodiment of FIG. 13.
Figure 15A:
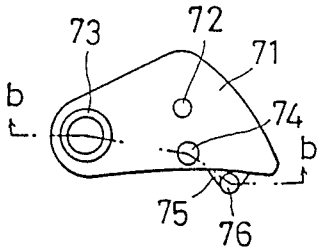
FIG. 15*a* is a plan view of a centrifugal weight.
Figure 15B:
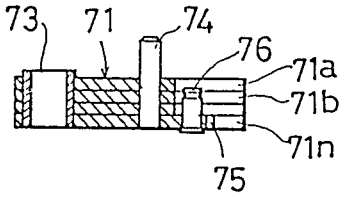
FIG. 15*b* is a sectional view taken along line b—b of FIG. 15*a;*

The centrifugal spark-advance control device 65 is shown in some detail in FIGS. 13 and 14. In FIG. 13, in order to show the positional relationship between the retainer plate, the centrifugal weights and the timing plate, they are shown in an artificial phase relationship. As best shown in FIG. 14, a rectangular retainer plate 68 having a pair of pivot pins 69 and a pair of spring pins 70 is fixedly secured to the input shaft 62 and the centrifugal weights 71 are freely rotatably fitted over the pivot pins 68 by way of collars 73 as described hereinafter. As best shown in FIGS. 15*a* and 15*b*, the centrifugal weights 71 are each provided with a cam follower pin 74 and consist of a plurality of steel plates 71*a* to 71*n* which are layered over one another and integrally joined together by a rivet 72. The collar 73 and the cam follower pin 74 are press fitted into the centrifugal weight 71 and the lower most steel plate 71 is provided with an extension bracket 75 at a part remote from the collar 73. A spring pin 76 is press fitted into a hole provided in this extension bracket 75.

The free ends of the pins 76 and 70 are provided with annular grooves for engaging a spring 78 of a relatively larger diameter and a spring 79 of a relatively smaller diameter which is received in the spring 78 thereto, respectively, and one of the springs 79 for instance the spring of a relatively smaller diameter is made longer than the other spring 78 so as to define a play in the engagement between the former spring 79 and the corresponding pin 70. Thus, the spring force acts upon the centrifugal weights 71 in two stages, but this feature is not directly related to the present invention and in no way limits the scope of claim of the present invention.

A hollow drive shaft 80 of the pulse generator 66 is loosely fitted over the free end 62*a* of the input shaft 62 and the base end of this drive shaft 80 is integrally provided with a rectangular timing plate 81 which is provided with a pair of cam slots 82 at diagonally opposing positions thereof for receiving the cam follower pins 74 therein.

Figure 16:
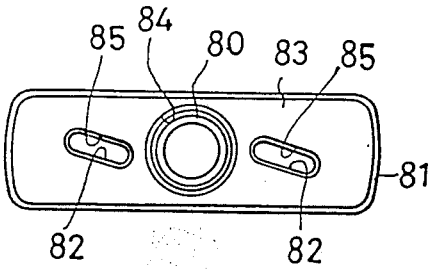
FIG. 16 is a plan view of a timing plate.
Figure 17:
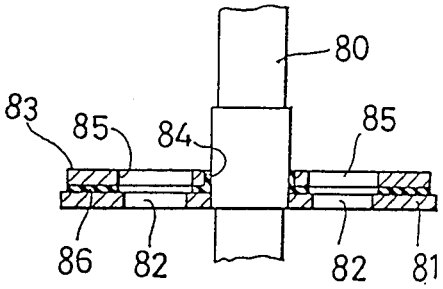
FIG. 17 is a sectional view of the timing plate of FIG. 16.

As best shown in FIGS. 16 and 17, the timing plate 81 is provided with an anti-vibration mass plate 83 attached to one of major surfaces thereof by way of a rubber layer 86. This anti-vibration mass plate 83 is substantially conformal to the timing plate 81 but slightly smaller than the latter, and a central hole 84 receives the drive shaft 80 defining certain clearance therebetween. The anti-vibration mass plate 83 is further provided with a pair of slots 85 which coincide with the cam slots 82 and are slightly greater in size than the cam slots 82 so as to expose the whole periphery of the cam slots 84.

In the same manner as in the previously described embodiments, the anti-vibration mass plate 83 serves the purpose of controlling the vibration of the timing plate 81 and the drive shaft 80 serves the purpose of holding the anti-vibration mass plate 83 in place as the pins 30 and 55 of the previous embodiments in case the rubber layer 86 should lose its capability to hold the anti-vibration mass plate 83 and the timing plate 81 together.

Thus, as the input shaft rotates, the whole assembly rotates in counter-clockwise direction as indicated by the arrow in FIG. 14. As the rotational speed increases, the centrifugal weights 71 rotate in counter-clockwise direction about the pivot pins 69 against the spring force of the coil springs 78 and 79 with the result that the cam follower pins 74 push the cam slots 82 so as to turn the timing plate 81 and the drive shaft 80 which is integral therewith in the counter-clockwise direction and advance the angular position of the drive shaft 80 with respect to the retainer plate 68 or the input shaft 62.

As best shown in FIG. 13, the pulse generator 66 comprises a variable reluctance member 88 fixedly secured to the drive shaft 80, an ignition timing detection coil 90 which is stationary and surrounds the drive shaft 80, a permanent magnet 92 fixedly attached to a moveable base 91, a stator core 93 and a vacuum spark-advance control device 94 which is connected to the moveable base 91.

The distributor unit 67 of this spark distributor is provided with a rotor 96 which is fixedly secured to the free end of the drive shaft 80, a brush 96 attached to the free end surface of the rotor 96, a central electrode 97 provided in the center of the cap 61 and secondary electrodes 98 which surround the central electrode 97 in spaced relationship.

As described above, according to the present invention, since an anti-vibration mass is attached to the timing plate by way of an elastic member, the vibration which is transmitted from a cam shaft and an input shaft to the timing plate can be reduced by the action of a dynamic damper and the spark timing can be stabilized in all speed ranges of the engine. In particular, in some of the embodiments, since the anti-vibration mass plate is fitted over a pair of pins or a drive shaft, even when the bonding action of the elastic member is lost, the anti-vibration mass plate is held in place and the anti-vibration action may be lost but the possibility of generating vibrations due to unbalance of a rotating mass can be minimized.

Thus, according to the present invention, since a timing plate is provided with a mass by way of an elastic support, the vibration of the timing plate and the resulting fluctuation in the spark advance angle particularly in high speed ranges can be effectively minimized. Furthermore, since this is accomplished with a simple structure, the performance of the spark advance-angle control device can be improved without increasing the size, the weight or the cost the spark distributor.

Although the present invention has been shown and described with reference to the preferred embodiments thereof, it should not be considered as limited thereby. Various possible modifications and alterations could be conceived of by one skilled in the art to any particular embodiment, without departing from the scope of the invention.

What we claim is:

1. A centrifugal spark-advance control device for an ignition system of an internal combustion engine, comprising:

an input shaft which rotates at a speed corresponding to the rotational speed of the engine;

a base plate fixedly attached to the input shaft;

a timing member which is rotatably supported on the base plate;

a biasing means for biasing the timing member in a certain direction;

a centrifugal weight which is pivoted to the base plate at a point spaced from the center of gravity of the centrifugal weight and which is provided with a cam surface for rotatably driving the timing member in an opposite direction against the biasing force of the biasing means by cooperating with a corresponding cam follower surface provided in the timing member;

a spark generating means coupled to the timing member for generating ignition sparks in synchronism with the rotational angle of the timing member;

a mass member attached to the timing plate by way of an elastic member.

2. A centrifugal spark-advance control device as defined in claim 1, wherein the timing member comprising a timing plate which is adapted to rotate in a major plane thereof and the mass member comprises a mass plate which is attached to a major surface of the timing plate by way of an elastic member consisting of a layer of elastomer material.

3. A centrifugal spark-advance control device as defined in claim 2, wherein the timing plate has a pair of arms extending radially on either side of the rotational center thereof and each carrying the mass plate thereon.

4. A centrifugal spark-advance control device as defined in claim 3, wherein the free ends of the arms of the timing plate are each provided with an extension extending in circumferential direction and the mass plates are carried by these circumferential extensions.

5. A centrifugal spark-advance control device as defined in claim 4, wherein the timing plate and the mass plate are provided with holes which are filled with part of the material of the elastomer layer.

6. A centrifugal spark-advance control device as defined in claim 5, wherein the biasing means comprises a coil springs which is engaged to the timing plate at one end thereof and to the base plate at the other end thereof.

7. A centrifugal spark-advance control device as defined in claim 6, wherein the base plate end of the coil spring is engaged to a pivot pin which rotatably supports the centrifugal weight on the base plate.

8. A centrifugal spark-advance control device as defined in any one of previous claims, wherein a pin which is integrally connected to the timing plate is passed through the mass plate defining a certain clearance therebetween.

9. A centrifugal spark-advance control device as defined in claim 8, wherein the pin which is passed through the mass plate engages the timing plate end of the coil spring.

10. A centrifugal spark-advance control device as defined in claim 8, wherein the free end of the pin which is passed through the mass plate is greater in radial extent than a hole of the mass plate which receives the pin.

11. A centrifugal spark-advance control device as defined in claim 2, wherein the centrifugal weight is provided with a cam follower pin while the timing plate is provided with a cam slot receiving the cam follower pin.

12. A centrifugal spark-advance control device as defined in claim 11, wherein the mass plate covers a substantially whole major surface of the timing plate except for the cam slot.

13. A centrifugal spark-advance control device as defined in claim 12, wherein a central shaft of the timing plate which is integrally connected to the timing plate is passed through the mass plate defining a certain clearance therebetween.

14. A centrifugal spark-advance control device as defined in claim 13, wherein the clearance is filled with part of the material of the elastomer layer.

15. A centrifugal spark-advance control device as defined in claim 12, 13 or 14, wherein the timing plate and the mass plate are provided with holes which are filled with part of the material of the elastomer layer.

* * * * *